US011053865B2

(12) United States Patent
Masuda et al.

(10) Patent No.: US 11,053,865 B2
(45) Date of Patent: Jul. 6, 2021

(54) COMPRESSION RATIO CONTROL DEVICE AND ENGINE

(71) Applicant: IHI Corporation, Tokyo (JP)

(72) Inventors: Yutaka Masuda, Tokyo (JP); Yoshiyuki Umemoto, Tokyo (JP); Takahiro Takimoto, Tokyo (JP); Jun Teramoto, Tokyo (JP); Kazuki Yotsui, Tokyo (JP); Keitoku Iguchi, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 17/021,101

(22) Filed: Sep. 15, 2020

(65) Prior Publication Data

US 2020/0408158 A1 Dec. 31, 2020

Related U.S. Application Data

(63) Continuation of application No. PCT/JP2019/011836, filed on Mar. 20, 2019.

(30) Foreign Application Priority Data

Mar. 28, 2018 (JP) ..... JP2018-063299

(51) Int. Cl.

| | |
|---|---|
| ***F02B 75/04*** | (2006.01) |
| ***F02D 15/02*** | (2006.01) |
| ***B63H 3/00*** | (2006.01) |
| ***F02B 61/04*** | (2006.01) |

(52) U.S. Cl.

CPC ..... *F02D 15/02* (2013.01); *B63H 3/00* (2013.01); *F02B 61/04* (2013.01); *F02B 75/04* (2013.01); *F02D 2200/024* (2013.01); *F02D 2200/0614* (2013.01); *F02D 2200/101* (2013.01); *F02D 2200/50* (2013.01)

(58) Field of Classification Search

CPC ..... F02D 15/02; F02D 2200/0614; F02D 2200/101; F02D 2200/50; F02D 2200/024; F02D 35/023; F02D 45/00; F02D 41/009; F02D 31/001; B63H 3/00; F02B 61/04; F02B 75/05; F02B 75/045; F02B 25/04

USPC ..... 123/48 B, 78 E

See application file for complete search history.

(56) References Cited

U.S. PATENT DOCUMENTS

| | | | |
|---|---|---|---|
| 2009/0187329 | A1 | 7/2009 | Akihisa et al. |
| 2015/0075485 | A1 | 3/2015 | Yamada et al. |

FOREIGN PATENT DOCUMENTS

| | | | |
|---|---|---|---|
| EP | 2 687 707 | A2 | 1/2014 |
| JP | S63-150048 | U1 | 10/1988 |
| JP | 2000-204963 | A | 7/2000 |
| JP | 2005-155506 | A | 6/2005 |

(Continued)

OTHER PUBLICATIONS

International Search Report dated Apr. 16, 2019 issued in International Application No. PCT/JP2019/011836 (3 pages).

*Primary Examiner* — Hai H Huynh

(74) *Attorney, Agent, or Firm* — Rothwell, Figg, Ernst & Manbeck, P.C.

(57) ABSTRACT

A compression ratio control device includes a compression ratio controller configured to control a compression ratio of a combustion chamber so that the maximum combustion pressure approaches a combustion pressure upper limit value (cylinder-internal-pressure upper limit value) based on a detection signal of a detector at least when an engine load is equal to or less than a predetermined load (engine full load).

12 Claims, 14 Drawing Sheets

(56) References Cited

FOREIGN PATENT DOCUMENTS

| | | | |
|---|---|---|---|
| JP | 2006-052697 | A | 2/2006 |
| JP | 2007-303423 | A | 11/2007 |
| JP | 2010-203308 | A | 9/2010 |
| JP | 2013-253529 | A | 12/2013 |
| JP | 2014-20375 | A | 2/2014 |

COMPRESSION RATIO CONTROL DEVICE AND ENGINE

CROSS REFERENCE TO RELATED APPLICATIONS

This application is a continuation application of International Application No. PCT/JP2019/011836, filed on Mar. 20, 2019, which claims priority to Japanese Patent Application No. 2018-063299, filed on Mar. 28, 2018, the entire contents of which are incorporated by reference herein.

BACKGROUND ART

Technical Field

The present disclosure relates to a compression ratio control device and an engine.

Related Art

In a crosshead type engine described in Patent Literature 1, a hydraulic mechanism is provided between a piston rod and a crosshead pin. In Patent Literature 1, the hydraulic mechanism is operated to cause the piston rod to move up and down so that a compression ratio of the crosshead type engine may be varied.

CITATION LIST

Patent Literature

Patent Literature 1:JP 2014-20375 A

SUMMARY

Technical Problem

In Patent Literature 1, fuel efficiency is improved by changing the compression ratio, for example, when a supplied fuel is changed from diesel oil to gas. However, development of a technology capable of further improving the fuel efficiency of an engine is longed for.

The present disclosure has an object to provide a compression ratio control device capable of improving fuel efficiency of an engine, and to provide an engine.

Solution to Problem

In order to solve the above-mentioned problem, a compression ratio control device of the present disclosure includes: a detector configured to detect a signal correlating with at least one of an engine load or the maximum combustion pressure in a combustion chamber; and a controller configured to control a compression ratio of the combustion chamber so that the maximum combustion pressure approaches a combustion pressure upper limit value set in advance based on the detected signal of the detector at least when the engine load is equal to or less than a predetermined load.

The controller may perform control so that the compression ratio is a highest compression ratio within a range in which the maximum combustion pressure is less than the combustion pressure upper limit value.

The compression ratio control device may further include a compression ratio varying mechanism configured to vary a top dead center position of a piston in a cylinder.

The detector may include at least one sensor selected from the group consisting of a rotation speed detection sensor configured to detect an engine rotation speed, an injection amount detection sensor configured to detect an injection amount of a fuel supplied to the combustion chamber, a pressure detection sensor configured to detect a pressure in the combustion chamber, and a scavenging pressure detection sensor configured to detect a scavenging pressure, which is a pressure of an active gas supplied to the combustion chamber.

The controller may compare the maximum combustion pressure detected by the pressure detection sensor and the combustion pressure upper limit value with each other, to thereby control the compression ratio so that the maximum combustion pressure approaches the combustion pressure upper limit value.

The controller may estimate the maximum combustion pressure based on the scavenging pressure detected by the scavenging pressure detection sensor, the compression ratio, and a specific heat ratio, and to compare the estimated maximum combustion pressure and the combustion pressure upper limit value with each other, to thereby control the compression ratio so that the maximum combustion pressure approaches the combustion pressure upper limit value.

The detector may include an angle detection sensor configured to detect an angle of a blade of a variable-pitch propeller, and the controller may derive the maximum combustion pressure based on the angle of the blade and the engine rotation speed, and to compare the derived maximum combustion pressure and the combustion pressure upper limit value with each other, to thereby control the compression ratio so that the maximum combustion pressure approaches the combustion pressure upper limit value.

Further, an engine of the present disclosure may include the compression ratio control device described above.

Effects of Disclosure

According to the compression ratio control device and the engine of the present disclosure, it is possible to improve the fuel efficiency of the engine.

DESCRIPTION OF EMBODIMENT

Figure 1:
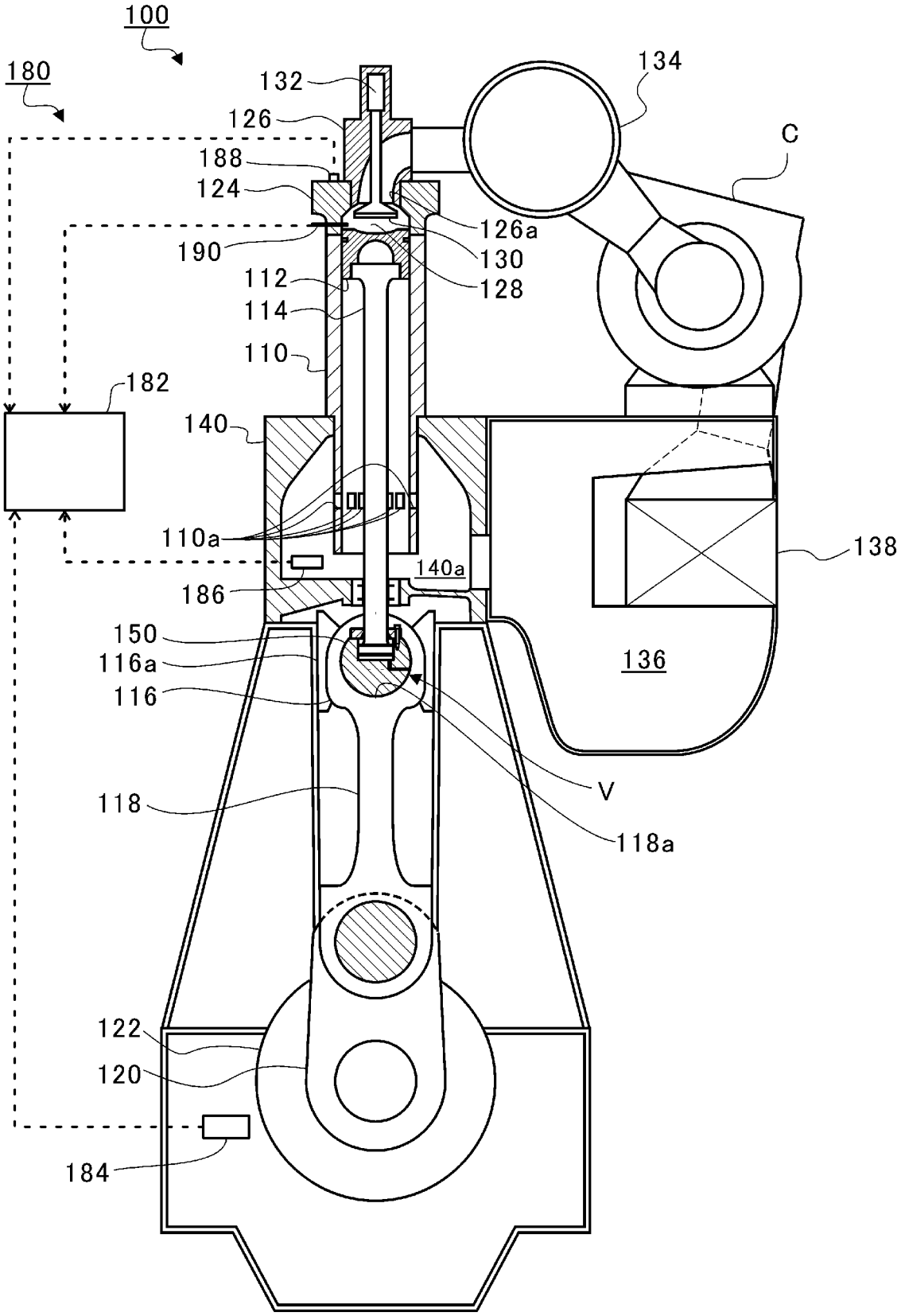
FIG. 1 is an explanatory view for illustrating an overall configuration of an engine.

Now, with reference to the attached drawings, an embodiment of the present disclosure is described in detail. The dimensions, materials, and other specific numerical values represented in the embodiment are merely examples used for facilitating the understanding of the disclosure, and do not limit the present disclosure otherwise particularly noted. Elements having substantially the same functions and configurations herein and in the drawings are denoted by the same reference symbols to omit redundant description thereof. Further, illustration of elements with no direct relationship to the present disclosure is omitted.

FIG. 1 is an explanatory view for illustrating an overall configuration of an engine 100. As illustrated in FIG. 1, the engine 100 includes a cylinder 110, a piston 112, a piston rod 114, a crosshead 116, a connecting rod 118, a crankshaft 120, a flywheel 122, a cylinder cover 124, an exhaust valve cage 126, a combustion chamber 128, an exhaust valve 130, an exhaust valve drive device 132, an exhaust pipe 134, a scavenge reservoir 136, a cooler 138, and a cylinder jacket 140.

The piston 112 is provided in the cylinder 110. The piston 112 is configured to reciprocate inside the cylinder 110. One end of the piston rod 114 is mounted to the piston 112. A crosshead pin 150 of the crosshead 116 is coupled to another end of the piston rod 114. The crosshead 116 is configured to reciprocate together with the piston 112. A movement of the crosshead 116 in a right-and-left direction (a direction perpendicular to a stroke direction of the piston 112) of FIG. 1 is restricted by a guide shoe 116*a*.

The crosshead pin 150 is axially supported by a crosshead bearing 118*a* provided at one end of the connecting rod 118. The crosshead pin 150 is configured to support one end of the connecting rod 118. Another end of the piston rod 114 and the one end of the connecting rod 118 are connected to each other through intermediation of the crosshead 116.

Another end of the connecting rod 118 is coupled to the crankshaft 120. The crankshaft 120 is rotatable with respect to the connecting rod 118. When the crosshead 116 reciprocates as the piston 112 reciprocates, the crankshaft 120 rotates. A rotation speed detection sensor 184 is provided in the engine 100. The rotation speed detection sensor 184 is provided in a vicinity of the crankshaft 120. The rotation speed detection sensor 184 is configured to detect an angle of the crankshaft 120, to thereby detect the engine rotation speed.

The flywheel 122 is mounted to the crankshaft 120. Rotations of the crankshaft 120 and the like are stabilized by an inertia of the flywheel 122. The cylinder cover 124 is provided at a top end of the cylinder 110. The exhaust valve cage 126 is inserted through the cylinder cover 124.

One end of the exhaust valve cage 126 faces the piston 112. An exhaust port 126*a* is opened at the one end of the exhaust valve cage 126. The exhaust port 126*a* is opened to the combustion chamber 128. The exhaust chamber 128 is formed inside the cylinder 110 so as to be surrounded by the cylinder cover 124, the cylinder 110, and the piston 112.

A valve body of the exhaust valve 130 is located in the combustion chamber 128. The exhaust valve drive device 132 is mounted to a rod portion of the exhaust valve 130. The exhaust valve drive device 132 is arranged in the exhaust valve cage 126. The exhaust valve drive device 132 moves the exhaust valve 130 in a stroke direction of the piston 112.

When the exhaust valve 130 moves toward the piston 112 side, the exhaust port 126*a* is opened. When the exhaust port 126*a* is opened, an exhaust gas generated in the cylinder 110 after the combustion is discharged from the exhaust port 126*a*. After the exhaust gas is discharged, when the exhaust valve 130 moves toward the exhaust valve cage 126 side, the exhaust port 126*a* is closed.

The exhaust pipe 134 is mounted to the exhaust valve cage 126 and a turbocharger C. An inside of the exhaust pipe 134 communicates with the exhaust port 126*a* and a turbine of the turbocharger C. The exhaust gas discharged from the exhaust port 126*a* is supplied to the turbine of the turbocharger C through the exhaust pipe 134, and is then discharged to the outside.

An active gas is pressurized by a compressor of the turbocharger C. In this state, the active gas is, for example, air. The pressurized active gas is cooled by the cooler 138 in the scavenge reservoir 136. A bottom end of the cylinder 110 is surrounded by the cylinder jacket 140. A scavenge chamber 140*a* is formed inside the cylinder jacket 140. The active gas after the cooling is forcibly fed into the scavenge chamber 140*a*.

Scavenging ports 110*a* are formed on a bottom end side of the cylinder 110. The scavenging port 110*a* is a hole passing from an inner peripheral surface to an outer peripheral surface of the cylinder 110. A plurality of scavenging ports 110*a* are formed at intervals in a circumferential direction of the cylinder 110.

When the piston 112 moves toward a bottom dead center position side with respect to the scavenging ports 110*a*, the active gas is sucked from the scavenging ports 110*a* into the cylinder 110 by a pressure difference between the scavenge chamber 140*a* and the inside of the cylinder 110. A scavenging pressure detection sensor 186 is provided in the scavenge chamber 140*a*. The scavenging pressure detection sensor 186 is configured to detect a scavenging pressure, which is a pressure of the active gas supplied into the cylinder 110 (combustion chamber 128).

A gas fuel injection valve (not shown) is provided in a vicinity of the scavenging ports 110*a*, or a portion of the cylinder 110 from the scavenging ports 110*a* to the cylinder cover 124. The fuel gas is injected from the gas fuel injection valve, and then flows into the cylinder 110.

A pilot injection valve (not shown) is provided in the cylinder cover 124. An appropriate amount of fuel oil is injected from the pilot injection valve into the combustion chamber 128. The fuel oil is vaporized, ignited, and combusted through heat of the combustion chamber 128, thereby increasing the temperature in the combustion chamber 128. Mixture of the fuel gas and the active gas compressed by the piston 112 is ignited by the heat of the combustion chamber 128, and is combusted. The piston 112 is configured to reciprocate through an expansion pressure generated by the combustion of the fuel gas (mixture). An injection amount detection sensor 188 is provided in the cylinder cover 124. The injection amount detection sensor 188 is configured to detect an injection amount of the fuel supplied from the gas fuel injection valve (not shown) into the combustion chamber 128. Moreover, a pressure detection sensor 190 is provided in the cylinder cover 124. The pressure detection sensor 190 is configured to detect a pressure in the cylinder 110 (combustion chamber 128).

The rotation speed detection sensor 184, the scavenging pressure detection sensor 186, the fuel injection amount detection sensor 188, and the pressure detection sensor 190 are connected to a compression ratio controller 182 described later, and are configured to output detection values (detection signals) to the compression ratio controller 182. In FIG. 1, flows of the signals are indicated by broken line arrows.

In this case, the fuel gas is produced by, for example, gasifying a liquefied natural gas (LNG). However, the fuel gas is not limited to those produced by gasifying the LNG, and there may also be used fuel gas produced by gasifying, for example, a liquefied petroleum gas (LPG), a light oil, or a heavy oil.

A compression ratio varying mechanism V is provided for the engine 100. A compression ratio control device 180 configured to control a compression ratio of the combustion chamber 128 is provided for the engine 100. The compression ratio control device 180 includes detectors such as the rotation speed detection sensor 184, the scavenging pressure detection sensor 186, the injection amount detection sensor 188, and the pressure detection sensor 190, and the compression ratio controller 182. The compression ratio controller 182 is configured to control the compression ratio varying mechanism V based on the signals obtained from the detectors such as the rotation speed detection sensor 184, the scavenging pressure detection sensor 186, the injection amount detection sensor 188, and the pressure detection sensor 190. A detailed description is now given of the compression ratio varying mechanism V and the compression ratio control device 180.

Figure 2A:
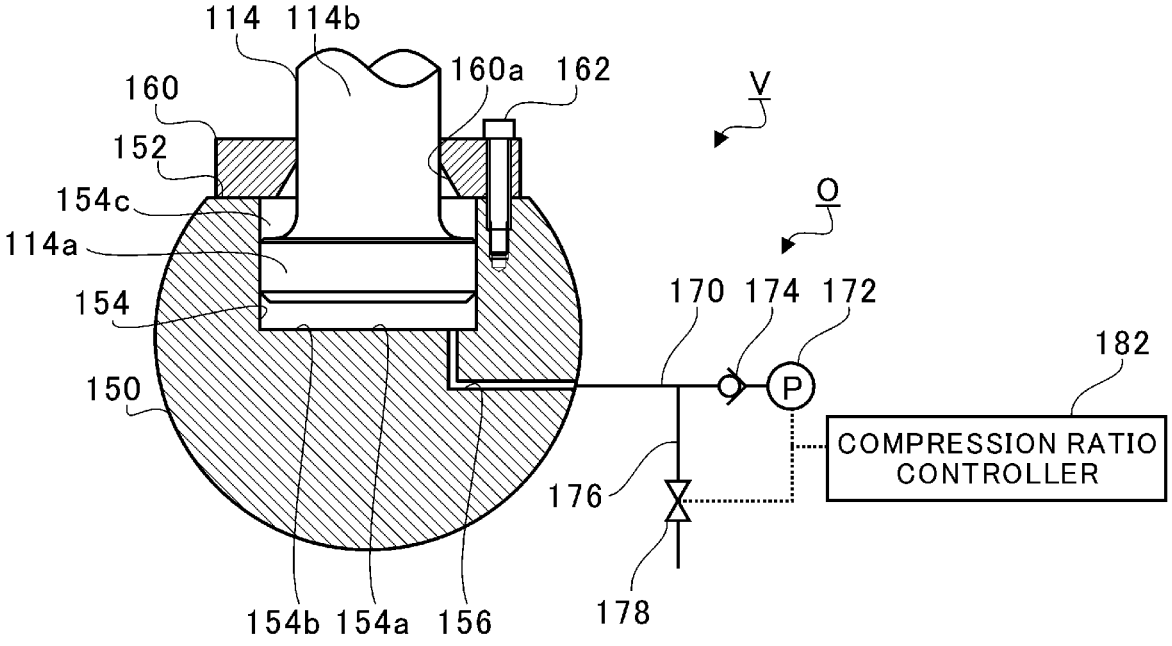
FIG. 2A is an extracted view for illustrating a coupling portion between a piston rod and a crosshead pin.
Figure 2B:
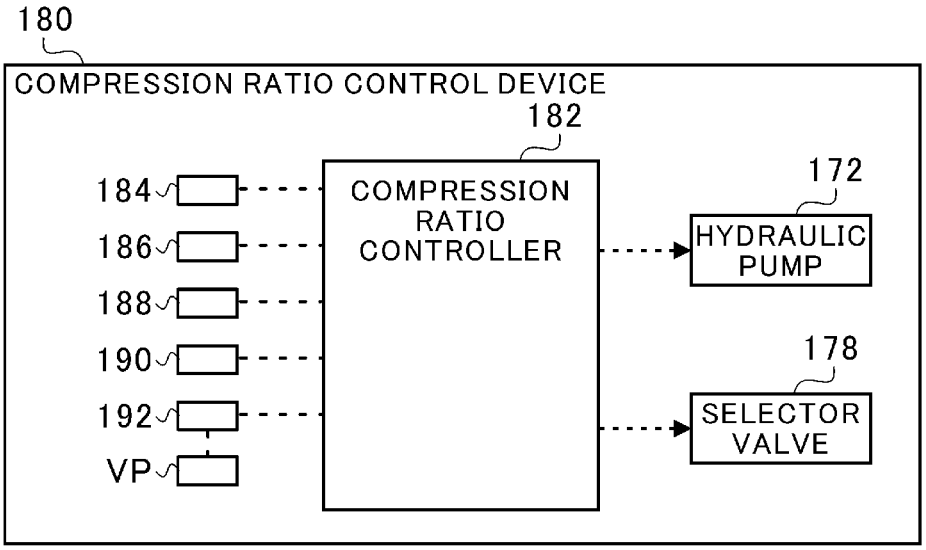
FIG. 2B is a functional block diagram for illustrating a compression ratio control device.

FIG. 2A and FIG. 2B are a schematic configuration view and a schematic configuration diagram for illustrating the compression ratio varying mechanism V and the compression ratio control device 180, respectively. FIG. 2A is an extracted view for illustrating a coupling portion between the piston rod 114 and the crosshead pin 150. FIG. 2B is a functional block diagram for illustrating the compression ratio control device 180. As illustrated in FIG. 2A, a flat surface portion 152 is formed on an outer peripheral surface of the crosshead pin 150 on the piston 112 side. The flat surface portion 152 extends in a direction substantially perpendicular to the stroke direction of the piston 112.

A pin hole 154 is formed in the crosshead pin 150. The pin hole 154 is opened in the flat surface portion 152. The pin hole 154 extends from the flat surface portion 152 toward the crankshaft 120 side (bottom side of FIG. 2) along the stroke direction.

A cover member 160 is provided on the flat surface portion 152 of the crosshead pin 150. The cover member 160 is mounted to the flat surface portion 152 of the crosshead pin 150 by a fastening member 162. The cover member 160 covers the pin hole 154. A cover hole 160*a* passing in the stroke direction is provided in the cover member 160.

The piston rod 114 includes a large-diameter portion 114*a* and a small-diameter portion 114*b*. An outer diameter of the large-diameter portion 114*a* is larger than an outer diameter of the small-diameter portion 114*b*. The large-diameter portion 114*a* is formed at the another end of the piston rod 114. The large-diameter portion 114*a* is inserted into the pin hole 154 of the crosshead pin 150. The small-diameter portion 114*b* is formed on the one end side of the piston rod 114 with respect to the large-diameter portion 114*a*. The small-diameter portion 114*b* is inserted into the cover hole 160*a* of the cover member 160.

A hydraulic chamber 154*a* is formed inside the pin hole 154. The pin hole 154 is partitioned by the large-diameter portion 114*a* in the stroke direction. The hydraulic chamber 154*a* is a space defined on a bottom surface 154*b* side of the pin hole 154 partitioned by the large-diameter portion 114*a*.

The compression ratio varying mechanism V includes a hydraulic pressure adjustment mechanism O. The hydraulic pressure adjustment mechanism O includes a hydraulic pipe 170, a hydraulic pump 172, a check valve 174, a branch pipe 176, and a selector valve 178.

One end of an oil passage 156 is opened in the bottom surface 154*b*. Another end of the oil passage 156 is opened to an outside of the crosshead pin 150. The hydraulic pipe 170 is connected to the another end of the oil passage 156. The hydraulic pump 172 communicates with the hydraulic pipe 170. The hydraulic pump 172 supplies working oil supplied from an oil tank (not shown) to the hydraulic pipe 170 based on an instruction from the compression ratio controller 182. The check valve 174 is provided between the hydraulic pump 172 and the oil passage 156. A flow of working oil flowing from the oil passage 156 side toward the hydraulic pump 172 is suppressed by the check valve 174. The working oil is forcibly fed into the hydraulic chamber 154*a* from the hydraulic pump 172 through the oil passage 156.

The branch pipe 176 is connected to the hydraulic pipe 170 between the oil passage 156 and the check valve 174. The selector valve 178 is provided to the branch pipe 176. The selector valve 178 is, for example, an electromagnetic valve. The selector valve 178 is controlled to an open state or a closed state based on an instruction from the compression ratio controller 182. The selector valve 178 is closed during operation of the hydraulic pump 172. When the selector valve 178 is opened while the hydraulic pump 172 is stopped, the working oil is discharged from the hydraulic chamber 154*a* toward the branch pipe 176 side. The selector valve 178 communicates with the oil tank (not shown) on a side of the selector valve 178 opposite to the oil passage 156. The discharged working oil is retained in the oil tank. The oil tank is configured to supply the working oil to the hydraulic pump 172.

The large-diameter portion 114*a* is configured to slide on an inner peripheral surface of the pin hole 154 in the stroke direction in accordance with an oil amount of the working oil in the hydraulic chamber 154*a*. As a result, the piston rod 114 moves in the stroke direction. The piston 112 moves together with the piston rod 114. A top dead center position of the piston 112 becomes variable through the movement of the piston rod 114 in the stroke direction.

The compression ratio varying mechanism V includes the hydraulic chamber 154*a* and the large-diameter portion 114*a* of the piston rod 114. The compression ratio varying mechanism V moves the top dead center position of the piston 112 so that the compression ratio is variable. The compression ratio varying mechanism V can vary the top dead center position and the bottom dead center position of the piston 112 in the cylinder 110 of the engine 100 through adjustment of the oil amount of the working oil to be supplied to the hydraulic chamber 154*a*.

Description has been given of the case in which the one hydraulic chamber 154*a* is provided. However, a space 154*c* on the cover member 160 side of the pin hole 154 partitioned by the large-diameter portion 114*a* may also be a hydraulic chamber. This hydraulic chamber may be used together with the hydraulic chamber 154*a* or may be used individually.

In FIG. 2B, a configuration relating to control for the compression ratio varying mechanism V is mainly illustrated. As illustrated in FIG. 2B, the compression ratio control device 180 includes the compression ratio controller 182. The compression ratio control device 180 is formed of, for example, an engine control unit (ECU). The compression ratio control device 180 is formed of a central processing unit (CPU), a ROM storing programs and the like, a RAM serving as a work area, and the like, and is configured to control the entire engine 100.

The compression ratio controller 182 is configured to control the hydraulic pump 172 and the selector valve 178 to move the top dead center position of the piston 112. In such a manner, the compression ratio controller 182 controls a geometrical compression ratio of the engine 100.

Figure 3A:
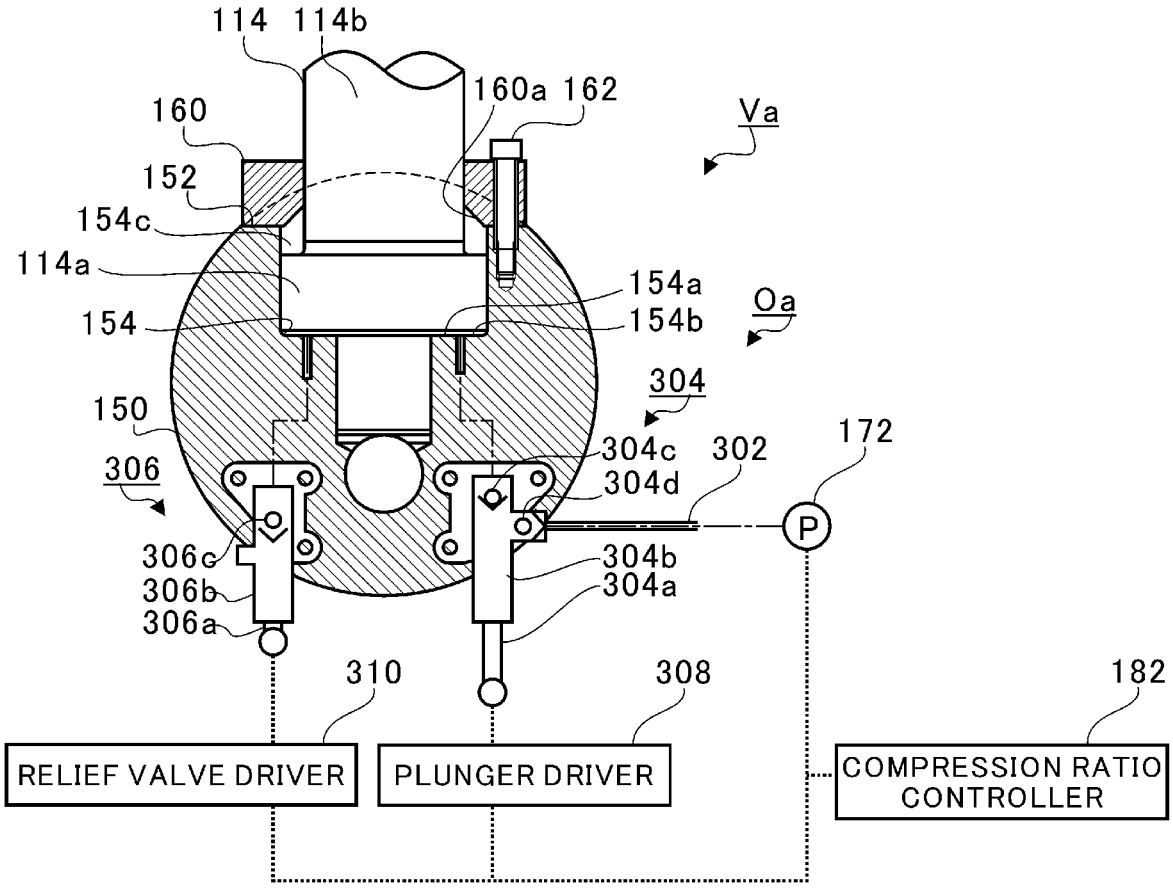
FIG. 3A is an extracted view for illustrating the coupling portion between the piston rod and the crosshead pin in a modification example.
Figure 3B:
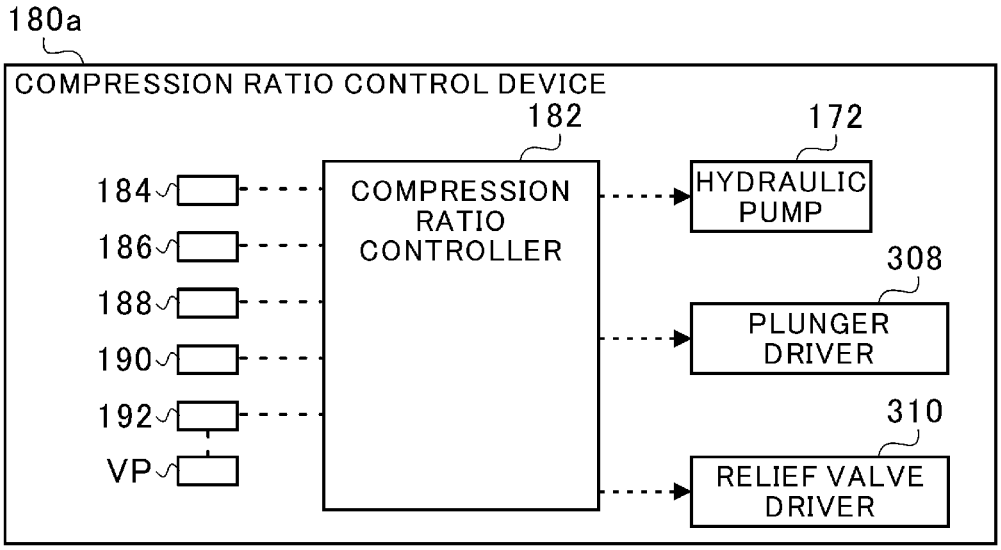
FIG. 3B is a functional block diagram for illustrating the compression ratio control device in the modification example.

FIG. 3A and FIG. 3B are respectively a schematic configuration view and a schematic configuration diagram for illustrating a compression ratio varying mechanism Va and a compression ratio control device 180*a* in a modification example. FIG. 3A is an extracted view for illustrating the coupling portion between the piston rod 114 and the crosshead pin 150 in the modification example. FIG. 3B is a functional block diagram for illustrating the compression ratio control device 180*a* in the modification example.

The compression ratio varying mechanism Va includes the hydraulic chamber 154*a* and the large-diameter portion 114*a* of the piston rod 114. The compression ratio varying mechanism Va includes a hydraulic pressure adjustment mechanism Oa. The hydraulic pressure adjustment mechanism Oa includes the hydraulic pump 172, a swiveling pipe 302, a plunger pump 304, a relief valve 306, a plunger driver 308, and a relief valve driver 310.

The hydraulic pump 172 supplies the working oil supplied from the oil tank (not shown) to the swiveling pipe 302 based on an instruction from the compression ratio controller 182. The swiveling pipe 302 is a pipe configured to connect the hydraulic pump 172 and the plunger pump 304 to each other. The swiveling pipe 302 is configured to be able to swivel between the plunger pump 304 moving together with the crosshead pin 150 and the hydraulic pump 172.

The plunger pump 304 is mounted to the crosshead pin 150. The plunger pump 304 includes a plunger 304*a* having a rod shape and a cylinder 304*b* having a tubular shape configured to slidably receive the plunger 304*a*.

The plunger pump 304 moves as the crosshead pin 150 moves so that the plunger 304*a* comes into contact with the plunger driver 308. The plunger pump 304 is slid in the cylinder 304*b* through the contact of the plunger 304*a* with the plunger driver 308, thereby increasing the pressure of the working oil in the cylinder 304*b* to supply the working oil increased in pressure to the hydraulic chamber 154*a*. A first check valve 304*c* is provided in an opening provided at an end of the cylinder 304*b* on a discharge side for the working oil. A second check valve 304*d* is provided in an opening formed in a side peripheral surface of the cylinder 304*b* on a suction side.

The plunger driver 308 is driven to a contact position, which is brought into contact with the plunger 304*a* and a non-contact position, which is not brought into contact with the plunger 304*a* based on instructions from the compression ratio controller 182. The plunger driver 308 comes into contact with the plunger 304*a*, to thereby press the plunger 304*a* toward the cylinder 304*b*.

The first check valve 304*c* is closed when a valve body is biased toward an inside of the cylinder 304*b*. When the first check valve 304*c* is closed, after the working oil has been supplied to the hydraulic chamber 154*a*, flowing back of the working oil into the cylinder 304*b* is suppressed. When a pressure of the working oil in the cylinder 304*b* becomes equal to or more than a biasing force (opening pressure) of a biasing member of the first check valve 304*c*, the valve body of the first check valve 304*c* is pushed by the working oil, thereby being opened.

The second check valve 304*d* is closed when a valve body is biased toward an outside of the cylinder 304*b*. When the second check valve 304*d* is closed, after the working oil has been supplied to the cylinder 304*b*, the flowing back of the working oil into the hydraulic pump 172 is suppressed. Moreover, when the pressure of the working oil supplied from the hydraulic pump 172 becomes equal to or more than a biasing force (opening pressure) of a biasing member of the second check valve 304*d*, the valve body of the second check valve 304*d* is pushed by the working oil, thereby being opened. The opening pressure of the first check valve 304*c* is set to be higher than the opening pressure of the second check valve 304*d*.

The relief valve 306 is mounted to the crosshead pin 150. The relief valve 306 is connected to the hydraulic chamber 154*a* and the oil tank (not shown). The relief valve 306 includes a rod 306*a* having a rod shape, a main body 306*b* having a tubular shape, and a valve body 306*c*. The main body 306*b* is configured to slidably receive the rod 306*a*. An internal flow passage is formed inside the main body 306*b*. The working oil discharged from the hydraulic chamber 154*a* flows through the internal flow passage. The valve body 306*c* is arranged in the internal flow passage of the main body 306*b*.

The relief valve 306 is configured to move as the crosshead pin 150 moves so that the rod 306*a* comes into contact with the relief valve driver 310. The relief valve driver 310 is driven to a contact position, which is brought into contact with the rod 306*a* and a non-contact position, which is not brought into contact with the rod 306*a* based on instructions from the compression ratio controller 182. The relief valve driver 310 comes into contact with the rod 306*a*, to thereby press the rod 306*a* toward the main body 306*b*. When the rod 306*a* is pressed toward the main body 306*b*, the rod 306*a* opens the valve body 306*c*. When the valve body 306*c* is opened, the working oil stored in the hydraulic chamber 154*a* is returned to the oil tank.

Each of the plunger driver 308 and the relief valve driver 310 includes a mechanism including a cam plate configured to perform operation control through, for example, a change in relative position to the plunger pump 304 or the relief valve 306. Moreover, each of the plunger driver 308 and the relief valve driver 310 includes a mechanism configured to use an actuator to drive the relative position of the cam plate.

In FIG. 3B, a configuration relating to control for the compression ratio varying mechanism Va is mainly illustrated. As illustrated in FIG. 3B, the compression ratio control device 180*a* includes the compression ratio controller 182. The compression ratio control device 180*a* is formed of, for example, an engine control unit (ECU). The compression ratio control device 180*a* is formed of a central processing unit (CPU), a ROM storing programs and the like, a RAM serving as a work area, and the like, and is configured to control the entire engine 100.

The compression ratio controller 182 is configured to control the hydraulic pump 172, the plunger driver 308, and the relief valve driver 310 to move the top dead center position of the piston 112. In such a manner, the compression ratio controller 182 controls a geometrical compression ratio of the engine 100.

Figure 4:
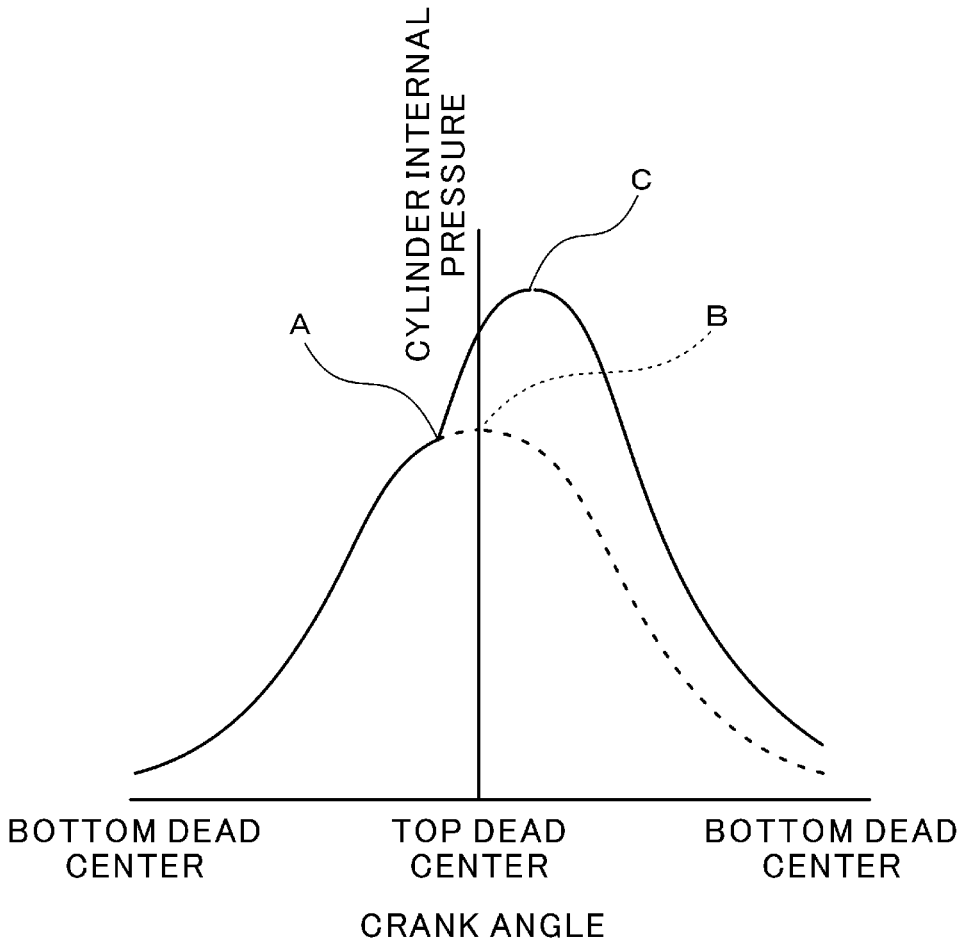
FIG. 4 is a graph for showing an example of a pressure in a cylinder measured by a pressure detection sensor.

Incidentally, an upper limit value (hereinafter referred to as "cylinder-internal-pressure upper limit value") of the pressure in the cylinder 110 is defined for the engine 100 from the view point of durability of the cylinder 110. FIG. 4 is a graph for showing an example of the pressure in the cylinder 110 measured by the pressure detection sensor 190. In FIG. 4, a vertical axis represents the pressure (cylinder internal pressure) in the cylinder 110, and a horizontal axis represents a crank angle.

As shown in FIG. 4, as the crank angle approaches the top dead center from the bottom dead center, the mixture (the air and the fuel) in the cylinder 110 is compressed by the piston 112, and the temperature and the pressure in the cylinder 110 increase (compression stroke). When the crank angle reaches a point A before the crank angle reaches the top dead center from the bottom dead center, the mixture in the cylinder 110 is combusted, and the combustion gas is expanded by heat generated by the combustion (the combustion stroke and the expansion stroke). A force for pushing down the piston 112 is generated through an increase in pressure by the expansion of the combustion gas.

In this embodiment, of the pressures in the cylinder 110 measured by the pressure detection sensor 190, a pressure in the compression stroke in which the crank angle is before the point A is referred to as "compression pressure Pcomp". Moreover, of the pressures in the cylinder 110 measured by the pressure detection sensor 190, a pressure in the combustion stroke and the expansion stroke in which the crank angle is after the point A is referred to as "combustion pressure P". Moreover, the maximum pressure of the combustion pressure P is referred to as "maximum combustion pressure Pmax". The maximum combustion pressure Pmax is the maximum pressure in the cylinder 110 measured by the pressure detection sensor 190 in one combustion cycle. A broken line of FIG. 4 indicates a compression pressure after the point A estimated from the pressure measured in the compression stroke. A point B of FIG. 4 indicates a peak position (peak value) of the estimated compression pressure. Moreover, a point C of FIG. 4 indicates a peak position (peak value) of the combustion pressure P, that is, a position of the maximum combustion pressure Pmax.

As described above, the cylinder-internal-pressure upper limit value (combustion pressure upper limit value) is defined for the engine 100. Therefore, the engine 100 needs to suppress the maximum combustion pressure Pmax so as to be equal to or less than the cylinder-internal-pressure upper limit value. The maximum combustion pressure Pmax changes in accordance with a scavenging pressure Ps, which is a pressure of the active gas supplied to the combustion chamber 128. Specifically, as the scavenging pressure Ps becomes larger, the maximum combustion pressure Pmax becomes larger. As the scavenging pressure Ps becomes smaller, the maximum combustion pressure Pmax becomes smaller.

The scavenging pressure Ps changes in accordance with engine load. Specifically, as the engine load (for example, the engine rotation speed) becomes larger, the scavenging pressure Ps becomes larger. As the engine load becomes smaller, the scavenging pressure Ps becomes smaller. Consequently, the maximum combustion pressure Pmax reaches the highest value at an engine full load (100% load) at which the scavenging pressure Ps becomes larger to the highest value, that is, the engine load becomes larger to the highest value. Therefore, the compression ratio of the engine 100 is usually set so that the maximum combustion pressure Pmax at the engine full load is the cylinder-internal-pressure upper limit value when the compression ratio of the combustion chamber 128 is fixed.

Figure 5A:
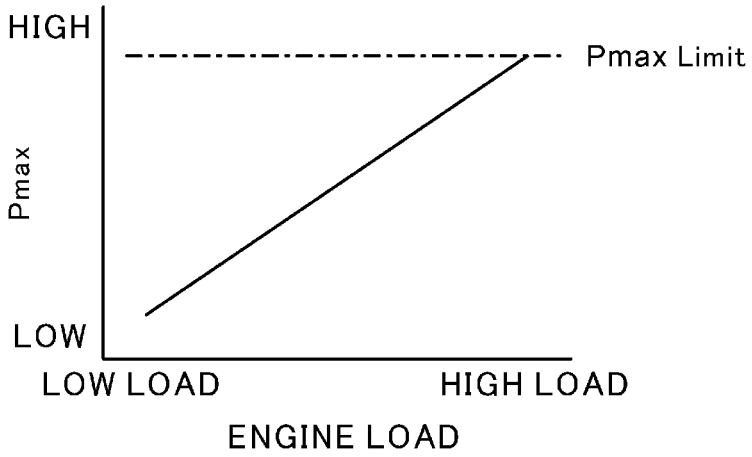
FIG. 5A is a graph for showing a relationship between an engine load and the maximum combustion pressure when a compression ratio of a combustion chamber is fixed.
Figure 5B:
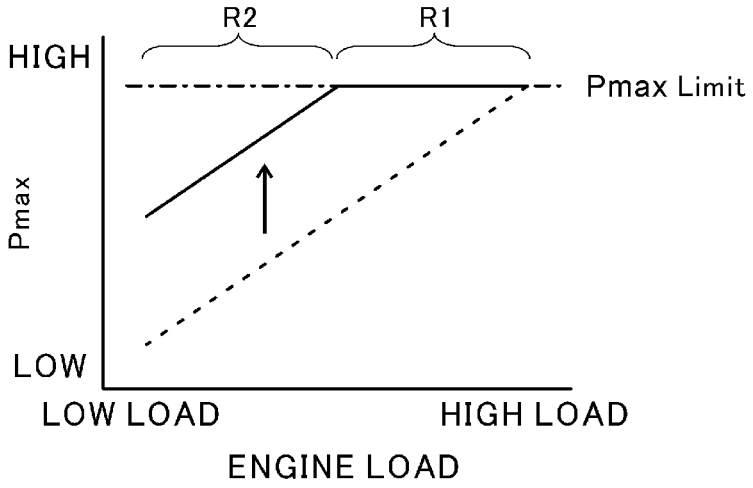
FIG. 5B is a graph for showing the relationship between the engine load and the maximum combustion pressure when the compression ratio of the combustion chamber is fixed and when the compression ratio is variable.

FIG. 5A and FIG. 5B are graphs showing a relationship between the engine load and the maximum combustion pressure Pmax. In each of FIG. 5A and FIG. 5B, a vertical axis represents the maximum combustion pressure Pmax, and a horizontal axis represents the engine load. FIG. 5A is a graph for showing a relationship between the engine load and the maximum combustion pressure Pmax when the compression ratio of the combustion chamber 128 is fixed. FIG. 5B is a graph for showing the relationship between the engine load and the maximum combustion pressure Pmax when the compression ratio of the combustion chamber 128 is fixed and when the compression ratio is variable. In FIG. 5A and FIG. 5B, a one-dot chain line indicates the cylinder-internal-pressure upper limit value Pmax Limit.

A solid line of FIG. 5A indicates the maximum combustion pressure Pmax changing in accordance with the engine load when the compression ratio of the combustion chamber 128 is fixed. As shown in FIG. 5A, when the compression ratio of the combustion chamber 128 is fixed, the maximum combustion pressure Pmax is the cylinder-internal-pressure upper limit value Pmax Limit in the engine full load state. As the maximum combustion pressure Pmax becomes larger, a fuel consumption rate can be reduced (that is, the fuel efficiency can be improved). Therefore, the fuel efficiency is improved in the engine full load state in which the maximum combustion pressure Pmax is the cylinder-internal-pressure upper limit value Pmax Limit.

However, as shown in FIG. 5A, when the compression ratio of the combustion chamber 128 is fixed, the maximum combustion pressure Pmax does not reach the cylinder-internal-pressure upper limit value Pmax Limit in a load state in which the engine load is lower than the engine load in the engine full load state. Consequently, in the example shown in FIG. 5A, there is a room for improving the fuel efficiency in a load state in which the engine load is lower than the engine load in the engine full load state.

Consequently, in this embodiment, at least in a state in which the engine load is equal to or less than a predetermined load, the compression ratio controller 182 controls the compression ratio of the combustion chamber 128 (compression ratio varying mechanism V) so that the maximum combustion pressure Pmax approaches the cylinder-internal-pressure upper limit value Pmax Limit set in advance. In this embodiment, the compression ratio controller 182 can acquire the detection value (the cylinder internal pressure including the maximum combustion pressure Pmax) output from the pressure detection sensor 190. Consequently, the compression ratio controller 182 compares the maximum combustion pressure Pmax detected by the pressure detection sensor 190 and the cylinder-internal-pressure upper limit value Pmax Limit with each other, and then controls the compression ratio so that the maximum combustion pressure Pmax approaches the cylinder-internal-pressure upper limit value Pmax Limit.

The compression ratio controller 182 controls the compression ratio varying mechanism V so that the compression ratio of the combustion chamber 128 becomes variable between a compression ratio ε0 and a compression ratio εn. The compression ratio ε0 is a compression ratio at which the compression ratio of the combustion chamber 128 is the lowest. The compression ratio εn is a compression ratio at which the compression ratio of the combustion chamber 128 is the highest.

A solid line of FIG. 5B indicates the maximum combustion pressure Pmax, which changes in accordance with the engine load when the compression ratio of the combustion chamber 128 is variable in this embodiment. In this embodiment, the compression ratio controller 182 controls the compression ratio varying mechanism V so that the compression ratio of the combustion chamber 128 is a lowest compression ratio ε0 in the engine full load state. As shown in FIG. 5B, when the compression ratio of the combustion chamber 128 is the lowest compression ratio ε0 in the engine full load state, the maximum combustion pressure Pmax is the cylinder-internal-pressure upper limit value Pmax Limit. In this configuration, a broken line of FIG. 5B indicates the maximum combustion pressure Pmax, which changes in accordance with the engine load when the compression ratio of the combustion chamber 128 is fixed to the lowest compression ratio ε0.

The compression ratio controller 182 controls the compression ratio varying mechanism V so that the compression ratio of the combustion chamber 128 is a compression ratio larger than the lowest compression ratio ε0 in a load state in which a load is smaller than the load in the engine full load state. As described above, the maximum combustion pressure Pmax changes in accordance with the scavenging pressure Ps, but also changes in accordance with the compression ratio of the combustion chamber 128. Specifically, as the compression ratio becomes larger, the maximum combustion pressure Pmax becomes larger. As the compression ratio becomes smaller, the maximum combustion pressure Pmax becomes smaller.

Consequently, even when the scavenging pressure Ps decreases, and the maximum combustion pressure Pmax thus becomes smaller, the maximum combustion pressure Pmax can be made larger through changing the compression ratio of the combustion chamber 128 to a compression ratio larger than the lowest compression ratio ε0. As a result, the maximum combustion pressure Pmax can be caused to approach the cylinder-internal-pressure upper limit value Pmax Limit also in the load state in which the load is smaller than the load in the engine full load state.

As described above, the compression ratio controller 182 varies the compression ratio of the combustion chamber 128 so that the maximum combustion pressure Pmax is maintained to the cylinder-internal-pressure upper limit value Pmax Limit even when the engine load becomes smaller. An engine load region R1 shown in FIG. 5B is a range in which the maximum combustion pressure Pmax can be maintained to the cylinder-internal-pressure upper limit value Pmax Limit through changing the compression ratio of the combustion chamber 128 in the range from the lowest compression ratio ε0 to the highest compression ratio En.

In the engine load region R1, the compression ratio controller 182 can obtain a larger compression ratio when the compression ratio of the combustion chamber 128 is variable (the solid line of FIG. 5B) than the compression ratio when the compression ratio of the combustion chamber 128 is fixed (the broken line of FIG. 5B). As described above, as the compression ratio becomes larger, the maximum combustion pressure Pmax becomes larger.

Consequently, in the engine load region R1, the maximum combustion pressure Pmax when the compression ratio of the combustion chamber 128 is set to a compression ratio larger than the lowest compression ratio ε0 (the solid line of FIG. 5B) can be made larger than the maximum combustion pressure Pmax when the compression ratio is set to the lowest compression ratio ε0 (the broken line of FIG. 5B). As described above, the compression ratio controller 182 increases the compression ratio of the combustion chamber 128 as much as possible in the range in which the maximum combustion pressure Pmax does not exceed the cylinder-internal-pressure upper limit value Pmax Limit in the engine load region R1, thereby being able to improve the fuel efficiency.

An engine load region R2 shown in FIG. 5B is a range in which the maximum combustion pressure Pmax is less than the cylinder-internal-pressure upper limit value Pmax Limit even when the compression ratio of the combustion chamber 128 is set to the highest compression ratio En. In this graph, the engine load region R1 is an engine load region including the engine full load. Moreover, the engine load region R2 is a load region in which the load is smaller than the load in the engine load region R1.

In the engine load region R2, the maximum combustion pressure Pmax is less than the cylinder-internal-pressure upper limit value Pmax Limit whether the compression ratio of the combustion chamber 128 is fixed (broken line) or variable (solid line). However, when the compression ratio of the combustion chamber 128 is variable (solid line) in the engine load region R2, the compression ratio controller 182 can achieve the larger compression ratio εn than the compression ratio when the compression ratio of the combustion chamber 128 is fixed (broken line).

Consequently, in the engine load region R2, the maximum combustion pressure Pmax when the compression ratio of the combustion chamber 128 is variable (solid line) can be made larger than the maximum combustion pressure Pmax when the compression ratio is fixed (broken line). In such a manner, the compression ratio controller 182 increases the compression ratio of the combustion chamber 128 as much as possible, to thereby improve the fuel economy also in the engine load region R2.

With this configuration, the compression ratio controller 182 controls the compression ratio so that the compression ratio is the highest compression ratio in the range in which the maximum combustion pressure Pmax is less than the cylinder-internal-pressure upper limit value Pmax Limit. Specifically, the compression ratio controller 182 controls the compression ratio so as to be maintained to the highest compression ratio εn in the case in which the maximum combustion pressure Pmax is less than the cylinder-internal-pressure upper limit value Pmax Limit when the compression ratio is the highest compression ratio εn.

Figure 6A:
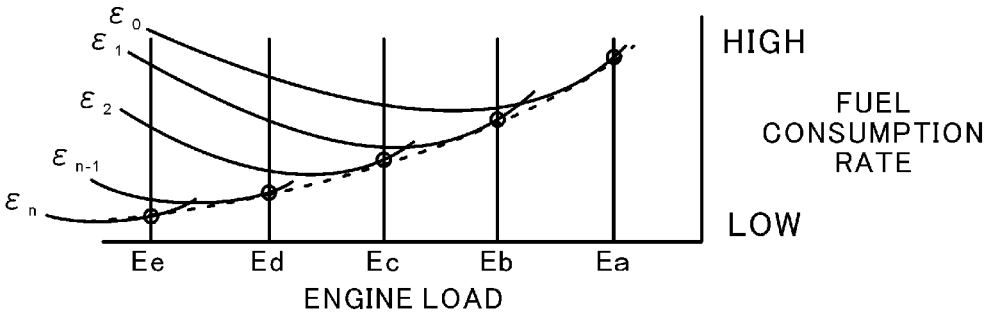
FIG. 6A is a graph for showing a relationship between a fuel consumption rate (fuel efficiency) and the engine load in an engine load region shown in FIG. 5B.

FIG. 6A, FIG. 6B, FIG. 6C, FIG. 6D, and FIG. 6E are graphs for showing performance of the engine 100 according to this embodiment. FIG. 6A is a graph for showing a relationship between a fuel consumption rate (fuel efficiency) and the engine load in the engine load region R1 shown in FIG. 5B. In FIG. 6A, a vertical axis represents the fuel consumption rate, and a horizontal axis represents the engine load. In FIG. 6A, engine loads becomes smaller in the order of Ea, Eb, Ec, Ed, and Ee. That is, a relationship among the engine loads Ea, Eb, Ec, Ed, and Ee is represented as Ea>Eb>Ec>Ed>Ed. The engine load Ea indicates an engine full load (100% load). The engine loads Ea, Eb, Ec, Ed, and Ee of FIG. 6B to FIG. 6E are also defined as the engine loads of FIG. 6A. Moreover, in FIG. 6A, a broken line indicates the lowest fuel consumption rate at which the fuel consumption rate is the lowest.

Figure 6B:
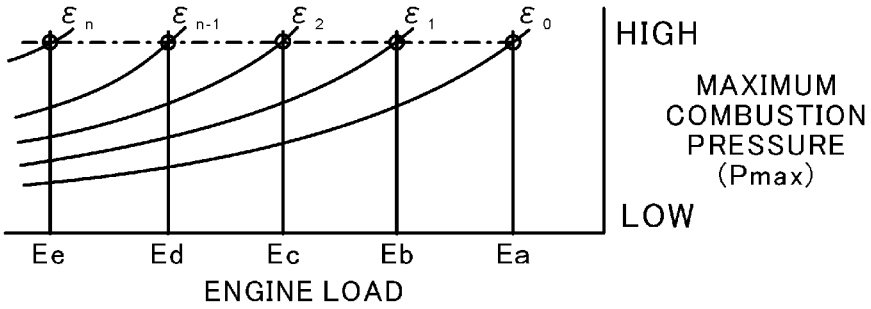
FIG. 6B is a graph for showing a relationship between the maximum combustion pressure and the engine load in the engine load region shown in FIG. 5B.

FIG. 6B is a graph for showing a relationship between the maximum combustion pressure Pmax and the engine load in the engine load region R1 shown in FIG. 5B. In FIG. 6B, a vertical axis represents the maximum combustion pressure Pmax, and a horizontal axis represents the engine load. Moreover, in FIG. 6B, a one-dot chain line indicates the cylinder-internal-pressure upper limit value Pmax Limit. The cylinder-internal-pressure upper limit value is a constant value independent of the engine load.

Figure 6C:
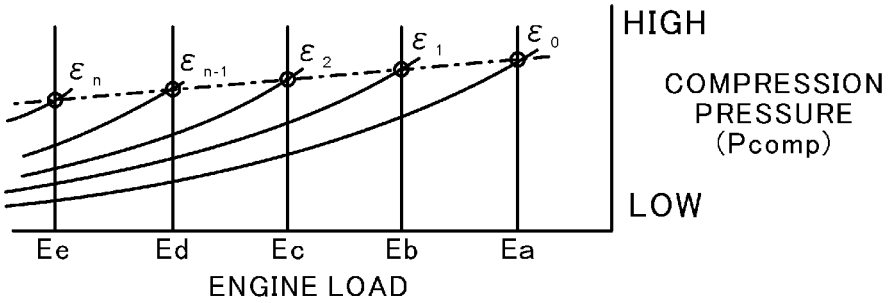
FIG. 6C is a graph for showing a relationship between a compression pressure and the engine load in the engine load region shown in FIG. 5B.

FIG. 6C is a graph for showing a relationship between the compression pressure Pcomp and the engine load in the engine load region R1 shown in FIG. 5B. In FIG. 6C, a vertical axis represents the compression pressure Pcomp, and a horizontal axis represents the engine load. In this graph, the compression pressure Pcomp is the estimated peak value of the compression pressure such as the point B of FIG. 4. Moreover, in FIG. 6C, a one-dot chain line indicates a target value (hereinafter referred to as "target compression pressure") of the estimated peak value of the compression pressure. The maximum combustion pressure Pmax can be caused to approach the cylinder-internal-pressure upper limit value Pmax Limit by causing the peak value of the compression pressure Pcomp to approach the target compression pressure. When the peak value of the compression pressure Pcomp is the target compression pressure, the maximum combustion pressure Pmax is the cylinder-internal-pressure upper limit value Pmax Limit.

As shown in FIG. 6C, the target compression pressure changes in accordance with the engine load, and is thus not a constant value. Specifically, the target compression pressure is a value that becomes smaller as the engine load becomes smaller, and becomes larger as the engine load becomes larger. This is because a difference Δ between the peak value of the compression pressure Pcomp indicated by the point B of FIG. 4 and the peak value (maximum combustion pressure Pmax) of the combustion pressure P indicated by the point C of FIG. 4 becomes larger as the engine load becomes larger. Even when the difference Δ becomes larger as the engine load becomes larger, the maximum combustion pressure Pmax can be a constant value independent of the engine load through increasing the target compression pressure as the engine load becomes larger.

Figure 6D:
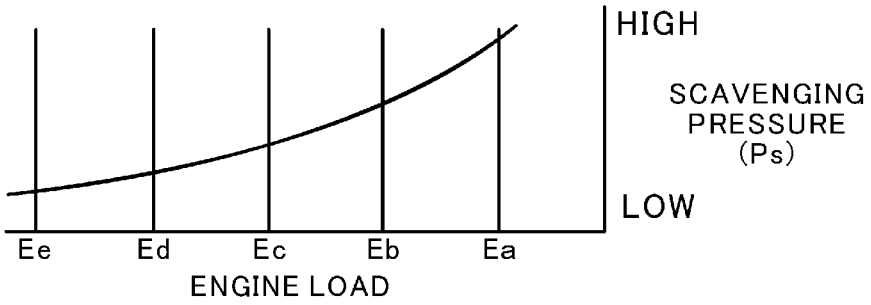
FIG. 6D is a graph for showing a relationship between a scavenging pressure and the engine load in the engine load region shown in FIG. 5B.

FIG. 6D is a graph for showing a relationship between the scavenging pressure Ps and the engine load in the engine load region R1 shown in FIG. 5B. In FIG. 6D, a vertical axis represents the scavenging pressure Ps, and the horizontal axis represents the engine load. As shown in FIG. 6D, the scavenging pressure Ps becomes larger as the engine load becomes larger, and becomes smaller as the engine load becomes smaller.

Figure 6E:
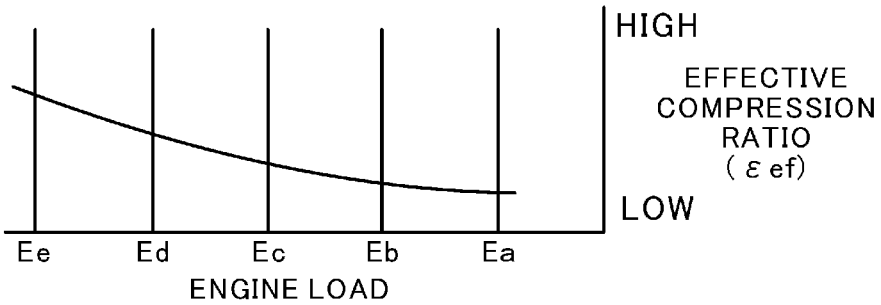
FIG. 6E is a graph for showing a relationship between an effective compression ratio and the engine load in the engine load region shown in FIG. 5B.

FIG. 6E is a graph for showing a relationship between an effective compression ratio εef and the engine load in the engine load region R1 shown in FIG. 5B. In FIG. 6E, a vertical axis represents the effective compression ratio εef, and the horizontal axis represents the engine load. As shown in FIG. 6E, the effective compression ratio εef becomes smaller as the engine load becomes larger, and becomes larger as the engine load becomes smaller. The effective compression ratio εef is an actual compression ratio of the combustion chamber 128, and is indicated by a ratio between a volume in the cylinder 110 at a moment when the scavenging ports 110*a* are closed and a volume of the combustion chamber 128 when the piston 112 reaches the top dead center.

As shown in FIG. 6B, when the engine load becomes smaller from the engine full load state in the order of the engine loads of Ea, Eb, Ec, Ed, and Ed, the compression ratio controller 182 changes the compression ratio of the combustion chamber 128 in the order of compression ratios of ε0, ε1, ε2, εn−1, and εn. The compression ratio is a value which becomes larger in the order of ε0, ε1, ε2, εn−1, and εn. That is, a relationship among the compression ratios ε0, ε1, ε2, εn−1, and εn is represented as ε0<ε1<ε2<εn−1<εn.

Specifically, the compression ratio controller 182 sets the compression ratio of the combustion chamber 128 to the compression ratio ε0 at the engine load Ea (engine full load). The maximum combustion pressure Pmax can be brought to the cylinder-internal-pressure upper limit value Pmax Limit by setting the compression ratio to the compression ratio ε0 at the engine load Ea. Moreover, the compression ratio controller 182 sets the compression ratio of the combustion chamber 128 to the compression ratio ε1 at the engine load Eb. The maximum combustion pressure Pmax can be brought to the cylinder-internal-pressure upper limit value Pmax Limit by setting the compression ratio to the compression ratio ε1 at the engine load Eb.

Moreover, the compression ratio controller 182 sets the compression ratio of the combustion chamber 128 to the compression ratio ε2 at the engine load Ec. The maximum combustion pressure Pmax can be brought to the cylinder-internal-pressure upper limit value Pmax Limit by setting the compression ratio to the compression ratio ε2 at the engine load Ec. Moreover, the compression ratio controller 182 sets the compression ratio of the combustion chamber 128 to the compression ratio εn−1 at the engine load Ed. The maximum combustion pressure Pmax can be brought to the cylinder-internal-pressure upper limit value Pmax Limit by setting the compression ratio to the compression ratio εn−1 at the engine load Ed. Moreover, the compression ratio controller 182 sets the compression ratio of the combustion chamber 128 to the compression ratio εn at the engine load Ee. The maximum combustion pressure Pmax can be brought to the cylinder-internal-pressure upper limit value Pmax Limit by setting the compression ratio to the compression ratio εn at the engine load Ee.

In this embodiment, at least when the engine load is equal to or less than the predetermined load (engine full load), the compression ratio controller 182 controls the compression ratio of the combustion chamber 128 so that the maximum combustion pressure Pmax approaches the cylinder-internal-pressure upper limit value Pmax Limit set in advance. The compression ratio controller 182 increases the compression ratio as the engine load becomes smaller from the engine full load state. As a result, even when the scavenging pressure Ps becomes smaller as shown in FIG. 6D, the maximum combustion pressure Pmax can be caused to approach the cylinder-internal-pressure upper limit value Pmax Limit as shown in FIG. 6B. As a result, as shown in FIG. 6A, the fuel consumption rate can be minimized (that is, the fuel efficiency can be improved) at each of the engine loads Ea to Ee.

Figure 7:
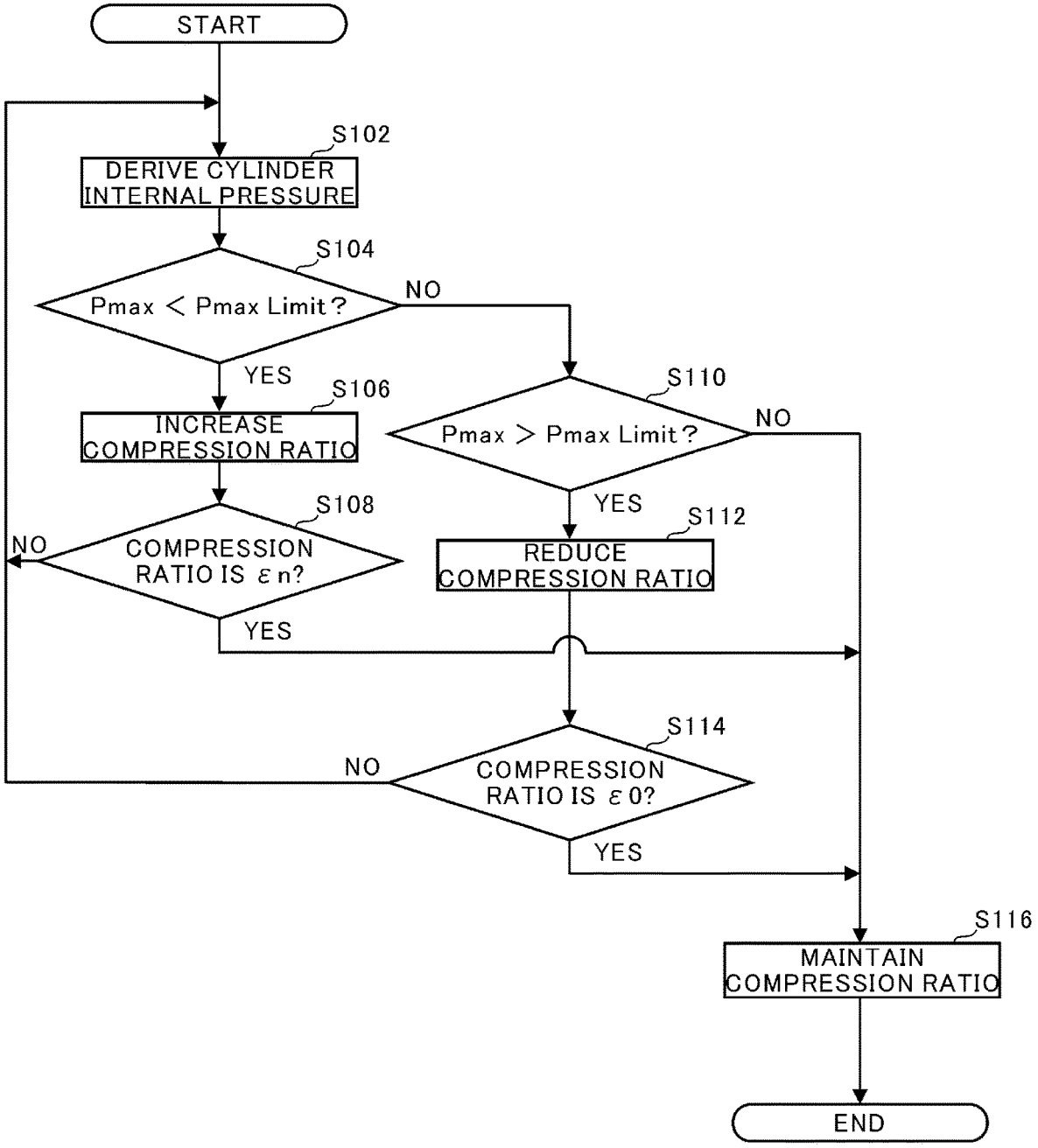
FIG. 7 is a flowchart for illustrating control processing for a compression ratio by a compression ratio controller.

FIG. 7 is a flowchart for illustrating control processing for the compression ratio by the compression ratio controller 182.

First, the compression ratio controller 182 derives the current cylinder internal pressure based on the signal output from the pressure detection sensor 190 (Step S102). Then, the compression ratio controller 182 determines whether or not the maximum combustion pressure Pmax is smaller than the cylinder-internal-pressure upper limit value Pmax Limit (Step S104). When the maximum combustion pressure Pmax is smaller than the cylinder-internal-pressure upper limit value Pmax Limit (YES in Step S104), the compression ratio controller 182 proceeds to Step S106. Meanwhile, when the maximum combustion pressure Pmax is equal to or more than the cylinder-internal-pressure upper limit value Pmax Limit (NO in Step S104), the compression ratio controller 182 proceeds to Step S110.

When the determination of YES is made in Step S104, the compression ratio controller 182 controls the compression ratio varying mechanism V so as to increase the compression ratio of the combustion chamber 128 (Step S106). After the compression ratio controller 182 increases the compression ratio of the combustion chamber 128, the compression ratio controller 182 determines whether or not the compression ratio of the combustion chamber 128 is the maximum compression ratio εn (Step S108). When the compression ratio of the combustion chamber 128 is the maximum compression ratio εn (YES in Step S108), the compression ratio controller 182 proceeds to Step S116. When the compression ratio of the combustion chamber 128 is not the maximum compression ratio εn (NO in Step S108), the compression ratio controller 182 returns to Step S102, and again executes the processing in Step S102 to Step S104.

When a determination of NO is made in Step S104, the compression ratio controller 182 determines whether or not the maximum combustion pressure Pmax is larger than the cylinder-internal-pressure upper limit value Pmax Limit (Step S110). When the maximum combustion pressure Pmax is larger than the cylinder-internal-pressure upper limit value Pmax Limit (YES in Step S110), the compression ratio controller 182 proceeds to Step S112. Meanwhile, when the maximum combustion pressure Pmax is equal to or less than the cylinder-internal-pressure upper limit value Pmax Limit, that is, when the maximum combustion pressure Pmax is the cylinder-internal-pressure upper limit value Pmax Limit (NO in Step S110), the compression ratio controller 182 proceeds to Step S116.

When the determination of YES is made in Step S110, the compression ratio controller 182 controls the compression ratio varying mechanism V so as to decrease the compression ratio of the combustion chamber 128 (Step S112). After the compression ratio controller 182 decreases the compression ratio of the combustion chamber 128, the compression ratio controller 182 determines whether or not the compression ratio of the combustion chamber 128 is the minimum compression ratio ε0 (Step S114). When the compression ratio of the combustion chamber 128 is the minimum compression ratio ε0 (YES in Step S114), the compression ratio controller 182 proceeds to Step S116. When the compression ratio of the combustion chamber 128 is not the minimum compression ratio ε0 (NO in Step S114), the compression ratio controller 182 returns to Step S102, and again executes the processing in Step S102, Step S104, and Step S110.

When the determination of YES is made in Step S108 or Step S114, and the determination of NO is made in Step S110, the compression ratio controller 182 controls the compression ratio varying mechanism V so that the compression ratio in the combustion chamber 128 is maintained (Step S116), and finishes the control processing for the compression ratio.

In the above-mentioned embodiment, description is given of the example in which the compression ratio controller 182 changes the compression ratio in accordance with the maximum combustion pressure Pmax measured by the pressure detection sensor 190. However, the maximum combustion pressure Pmax is not required to be measured by the pressure detection sensor 190. For example, the compression ratio controller 182 may estimate the maximum combustion pressure Pmax based on the scavenging pressure Ps measured by the scavenging pressure detection sensor 186 in place of the pressure detection sensor 190.

Specifically, the compression ratio controller 182 may estimate the maximum combustion pressure Pmax based on the scavenging pressure Ps, the compression ratio, and a specific heat ratio. The compression ratio controller 182 may compare the estimated maximum combustion pressure Pmax and the cylinder-internal-pressure upper limit value Pmax Limit with each other, and may then control the compression ratio so that the maximum combustion pressure Pmax approaches the cylinder-internal-pressure upper limit value Pmax Limit.

Moreover, in the above-mentioned embodiment, description is given of the example in which the compression ratio controller 182 changes the compression ratio in accordance with the maximum combustion pressure Pmax. However, the configuration is not limited to this example, and the compression ratio controller 182 may vary the compression ratio in accordance with the engine load. For example, the compression ratio controller 182 derives the engine load based on the engine rotation speed detected by the rotation speed detection sensor 184 and the fuel injection amount detected by the injection amount detection sensor 188. In this case, the compression ratio controller 182 includes a ROM storing, in advance, a map indicating a compression ratio corresponding to the engine load. The compression ratio controller 182 refers to the map stored in the ROM, thereby being capable of varying the compression ratio to a compression ratio corresponding to the derived engine load.

Moreover, the compression ratio controller 182 may include a ROM storing, in advance, a map indicating a compression ratio corresponding to the engine rotation speed. In this case, the compression ratio controller 182 refers to the map stored in the ROM, thereby being capable of varying the compression ratio to a compression ratio corresponding to the engine rotation speed detected by the rotation speed detection sensor 184. As described above, the compression ratio controller 182 varies the compression ratio to the compression ratio corresponding to the engine load or the engine rotation speed so that the maximum combustion pressure Pmax can be caused to approach the cylinder-internal-pressure upper limit value Pmax Limit at each engine load or each engine rotation speed.

Moreover, the compression ratio controller 182 may vary the compression ratio in accordance with the compression pressure Pcomp. For example, the compression ratio controller 182 estimates the peak value of the compression pressure Pcomp from the cylinder internal pressure measured by the pressure detection sensor 190. In this case, the compression ratio controller 182 includes a ROM storing, in advance, a map indicating a target compression pressure corresponding to the engine load or the engine rotation speed. The compression ratio controller 182 refers to the map stored in the ROM, thereby being capable of varying the compression ratio to a compression ratio at which the estimated peak value of the compression pressure is the target compression pressure. As described above, the compression ratio controller 182 varies the compression ratio to the compression ratio at which the peak value of the compression pressure Pcomp is the target compression pressure so that the maximum combustion pressure Pmax can be caused to approach the cylinder-internal-pressure upper limit value Pmax Limit at each engine load.

Moreover, the compression ratio controller 182 may estimate the maximum combustion pressure Pmax from the estimated peak value of the compression pressure and the difference Δ between the above-mentioned point B and point C of FIG. 4. In this case, the compression ratio controller 182 includes a ROM storing, in advance, a map indicating a difference Δ corresponding to the engine load or the engine rotation speed. The compression ratio controller 182 refers to the map stored in the ROM, thereby being capable of estimating the maximum combustion pressure Pmax from the estimated peak value of the compression pressure and the difference Δ. The compression ratio controller 182 may compare the estimated maximum combustion pressure Pmax and the cylinder-internal-pressure upper limit value Pmax Limit with each other, and may then control the compression ratio so that the maximum combustion pressure Pmax approaches the cylinder-internal-pressure upper limit value Pmax Limit.

As described above, the engine 100 includes the detectors (for example, the rotation speed detection sensor 184 and the pressure detection sensor 190) configured to detect the signals correlating with at least one of the engine load or the maximum combustion pressure in the combustion chamber 128. The compression ratio controller 182 can control the compression ratio so that the maximum combustion pressure Pmax approaches the cylinder-internal-pressure upper limit value Pmax Limit set in advance based on the signals acquired from the detectors.

Moreover, depending on the type of a driven member (for example, a propeller for a ship) driven by the engine 100, the engine load may vary even when the engine rotation speed is the same. For example, a fixed-pitch propeller and a variable-pitch propeller are given as the driven member driven by the engine 100. While the fixed-pitch propeller has a fixed angle of blades, the variable-pitch propeller can change the angle of the blades. Therefore, even when the variable-pitch propeller has the same rotation speed as the rotation speed of the fixed-pitch propeller, the variable-pitch propeller may apply a different engine load in accordance with the angle of the blades.

When the engine 100 drives the fixed-pitch propeller to rotate, the compression ratio controller 182 can control the compression ratio so that the maximum combustion pressure Pmax approaches the cylinder-internal-pressure upper limit value Pmax Limit through use of the above-mentioned method. However, when the engine 100 drives the variable-pitch propeller to rotate, in some cases, the compression ratio controller 182 is not be able to control the compression ratio so that the maximum combustion pressure Pmax approaches the cylinder-internal-pressure upper limit value Pmax Limit through use of the above-mentioned method.

Therefore, in a case in which the compression ratio controller 182 drives the variable-pitch propeller to rotate, when the compression ratio controller 182 cannot use the above-mentioned method to control the compression ratio, the compression ratio controller 182 may derive, for example, the maximum combustion pressure Pmax based on the angle of the blades of the variable-pitch propeller and the engine rotation speed. Then, the compression ratio controller 182 may compare the derived maximum combustion pressure Pmax and the cylinder-internal-pressure upper limit value Pmax Limit with each other, and may then control the compression ratio so that the maximum combustion pressure Pmax approaches the cylinder-internal-pressure upper limit value Pmax Limit.

Specifically, the compression ratio controller 182 can acquire information on the angle of the blades of the variable-pitch propeller VP from an angle detection sensor 192 (detector, see FIG. 2B and FIG. 3B) configured to be able to detect the angle of the blades of the variable-pitch propeller VP. In this case, the compression ratio controller 182 includes a ROM storing, in advance, a map indicating the maximum combustion pressure Pmax corresponding to the angle of the blades of the variable-pitch propeller VP and the engine rotation speed. The compression ratio controller 182 refers to the map stored in the ROM, thereby being capable of deriving the maximum combustion pressure Pmax from the current angle of the blades of the variable-pitch propeller VP and the engine rotation speed.

The map stored in the ROM may be a map indicating a compression ratio corresponding to the angle of the blades of the variable-pitch propeller VP and the engine rotation speed. In this case, the compression ratio controller 182 refers to the map stored in the ROM, thereby being capable of deriving the compression ratio from the current angle of the blades of the variable-pitch propeller VP and the engine rotation speed. Moreover, the compression ratio controller 182 can derive the engine load based on the angle of the blades of the variable-pitch propeller VP, the engine rotation speed, and the fuel injection amount. Consequently, the map stored in the ROM may be the above-mentioned map (for example, the map indicating the compression ratio corresponding to the engine load).

The embodiment has been described above with reference to the attached drawings, but, needless to say, the present disclosure is not limited to the above-mentioned embodiment. It is apparent that those skilled in the art may arrive at various alternations and modifications within the scope of claims, and those examples are construed as naturally falling within the technical scope of the present disclosure.

For example, in the above-mentioned embodiment, description is given of the two-cycle type, uniflow scavenging type, and crosshead type engine 100 as examples. However, the type of the engine is not limited to the two-cycle type, the uniflow scavenging type, and the crosshead type. It is only required that the present disclosure be applied to an engine. Moreover, in the above-mentioned embodiment, description is given of the example in which the gas fuel (fuel gas) is supplied to the inside of the cylinder 110 (combustion chamber 128). However, the configuration is not limited to this example, and a liquid fuel may be supplied to the inside of the cylinder 110 (combustion chamber 128). Moreover, the engine 100 may be, for example, of a dual fuel type, which chooses a gas fuel or a liquid fuel to be used. Moreover, the engine 100 is not limited to an engine for a boat, and may be an engine for, for example, an automobile.

INDUSTRIAL APPLICABILITY

The present disclosure can be applied to the compression ratio control device and the engine.

What is claimed is:

1. A compression ratio control device, comprising:

a detector configured to detect a signal correlating with at least one of an engine load or the maximum combustion pressure in a combustion chamber; and a controller configured to control a compression ratio of the combustion chamber so that the maximum combustion pressure approaches a combustion pressure upper limit value set in advance based on the detected signal of the detector at least when the engine load is equal to or less than a predetermined load.

2. The compression ratio control device according to claim 1, wherein the controller is configured to perform control so that the compression ratio is a highest compression ratio within a range in which the maximum combustion pressure is less than the combustion pressure upper limit value.

3. The compression ratio control device according to claim 2, further comprising a compression ratio varying mechanism configured to change a top dead center position of a piston in a cylinder.

4. The compression ratio control device according to claim 3, wherein the detector includes at least one sensor selected from a group consisting of: a rotation speed detection sensor configured to detect an engine rotation speed; an injection amount detection sensor configured to detect an injection amount of a fuel supplied to the combustion chamber; a pressure detection sensor configured to detect a pressure in the combustion chamber; or a scavenging pressure detection sensor configured to detect a scavenging pressure, which is a pressure of an active gas supplied to the combustion chamber.

5. The compression ratio control device according to claim 2, wherein the detector includes at least one sensor selected from a group consisting of: a rotation speed detection sensor configured to detect an engine rotation speed; an injection amount detection sensor configured to detect an injection amount of a fuel supplied to the combustion chamber; a pressure detection sensor configured to detect a pressure in the combustion chamber; or a scavenging pressure detection sensor configured to detect a scavenging pressure, which is a pressure of an active gas supplied to the combustion chamber.

6. The compression ratio control device according to claim 1, further comprising a compression ratio varying mechanism configured to change a top dead center position of a piston in a cylinder.

7. The compression ratio control device according to claim 6, wherein the detector includes at least one sensor selected from a group consisting of: a rotation speed detection sensor configured to detect an engine rotation speed; an injection amount detection sensor configured to detect an injection amount of a fuel supplied to the combustion chamber; a pressure detection sensor configured to detect a pressure in the combustion chamber; or a scavenging pressure detection sensor configured to detect a scavenging pressure, which is a pressure of an active gas supplied to the combustion chamber.

8. The compression ratio control device according to claim 1, wherein the detector includes at least one sensor selected from a group consisting of: a rotation speed detection sensor configured to detect an engine rotation speed; an injection amount detection sensor configured to detect an injection amount of a fuel supplied to the combustion chamber; a pressure detection sensor configured to detect a pressure in the combustion chamber; or a scavenging pressure detection sensor configured to detect a scavenging pressure, which is a pressure of an active gas supplied to the combustion chamber.

9. The compression ratio control device according to claim 8, wherein the controller is configured to compare the maximum combustion pressure detected by the pressure detection sensor and the combustion pressure upper limit value with each other, to thereby control the compression ratio so that the maximum combustion pressure approaches the combustion pressure upper limit value.

10. The compression ratio control device according to claim 8, wherein the controller is configured to estimate the maximum combustion pressure based on the scavenging pressure detected by the scavenging pressure detection sensor, the compression ratio, and a specific heat ratio, and to compare the estimated maximum combustion pressure and the combustion pressure upper limit value with each other, to thereby control the compression ratio so that the maximum combustion pressure approaches the combustion pressure upper limit value.

11. The compression ratio control device according to claim 8, wherein the detector comprises an angle detection sensor configured to detect an angle of a blade of a variable-pitch propeller, and wherein the controller is configured to derive the maximum combustion pressure based on the angle of the blade and the engine rotation speed, and to compare the derived maximum combustion pressure and the combustion pressure upper limit value with each other, to thereby control the compression ratio so that the maximum combustion pressure approaches the combustion pressure upper limit value.

12. An engine comprising the compression ratio control device of claim 1.

* * * * *